United States Patent [19]

Hall et al.

[11] Patent Number: 4,896,607

[45] Date of Patent: Jan. 30, 1990

[54] BOOSTED KINETIC ENERGY PENETRATOR FUZE

[76] Inventors: James C. Hall, Rte. 6, Box 324, Buffalo, Minn. 55313; Peter H. Van Sloun, 207-18th Ave. N., Hopkins, Minn. 55343

[21] Appl. No.: 319,853

[22] Filed: Mar. 3, 1989

Related U.S. Application Data

[63] Continuation of Ser. No. 254,146, Oct. 1, 1987, abandoned, which is a continuation of Ser. No. 930,991, Nov. 14, 1986, abandoned, which is a continuation of Ser. No. 521,878, Aug. 10, 1983, abandoned.

[51] Int. Cl.[4] ..... F42C 15/24; F42B 15/24

[52] U.S. Cl. ..... 102/247; 102/251; 102/254; 102/379

[58] Field of Search ..... 102/247, 379, 248, 251, 102/254

[56] References Cited

U.S. PATENT DOCUMENTS

| | | | |
|---|---|---|---|
| 559,495 | 5/1896 | Rapieff | 102/247 |
| 2,666,390 | 1/1954 | Brandt | 102/248 |
| 2,850,978 | 9/1958 | Franklin | 102/251 X |
| 2,918,870 | 12/1959 | Meister | 102/379 |
| 2,994,272 | 8/1961 | Saunderson | 102/254 |
| 3,498,225 | 3/1970 | Voida et al. | 102/248 |
| 3,554,128 | 1/1971 | Hoelzen | 102/248 |
| 3,955,508 | 5/1976 | Will et al. | 102/248 X |
| 4,240,351 | 12/1980 | San Miguel | 102/254 X |

FOREIGN PATENT DOCUMENTS

| | | | |
|---|---|---|---|
| 18185 | of 1906 | United Kingdom | 102/247 |

*Primary Examiner*—David H. Brown

*Attorney, Agent, or Firm*—Roger W. Jensen; John G. Shudy, Jr.

[57] ABSTRACT

A fuze for missile having a linear axis passing rearwardly through a forward penetrator, an explosive charge with the penetrator, a fuze rearward the explosive charge, a propulsion rocket rearward of the fuze, and a canister rearward of the rocket and containing a deployable parachute, the fuze containing timers for deploying the parachute from the canister a predetermined interval after release of the missile from confinement, and for igniting the rocket a predetermined interval after deployment of the parachute, a further timer for causing discharge of the explosive charge a predetermined interval after axial impact of the penetrator with a target, and a safe-arm arrangement for preventing discharge of the explosive charge prior to the impact of said penetrator.

10 Claims, 4 Drawing Sheets

BOOSTED KINETIC ENERGY PENETRATOR FUZE

This application is a continuation of application Ser. No. 254,146, filed Oct. 1, 1987, which is a continuation of application Ser. No. 930,991 filed on Nov. 14, 1986which is a continuation of application Ser. No. 521,878 filed on Aug. 10, 1983 all now abandoned.

FIELD OF THE INVENTION

This invention relates to the general field of munitions, and particularly to a "boosted kinetic energy penetrator" having an improved fuze.

BACKGROUND OF THE INVENTION

In the field of munitions a need has developed for devices operative to make hardened air strips unusable by aircraft. It has been found that bombs used to detonate upon contact with the surfaces do relatively little damage, as their force is expended horizontally and upwardly, and the kinetic energy given to falling munitions by gravity is not sufficient to cause significant penetration of the runway surface by the missile.

BRIEF SUMMARY OF THE INVENTION

The present invention increases the efficiency of such munitions by equipping them with rocket motors to boost the downward force available for penetrating the surface, and with fuzes which delay firing of the explosive charge for a sufficient time after impact, for example, 8 milliseconds, to allow the missile to reach a depth at which increased damage to the target occurs. This is accomplished by apparatus including a safe-arm arrangement which prevents premature firing of the missile not only in normal storage and transportation, but in its discharge and descent from the air vehicle which dispenses the munition.

When dispensed in groups, the missiles damage the target to an extent which makes it unavailable until major, time consuming repairs are accomplished.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals identify corresponding parts throughout the several views.

DESCRIPTION OF THE PREFERRED EMBODIMENT

Figure 1:
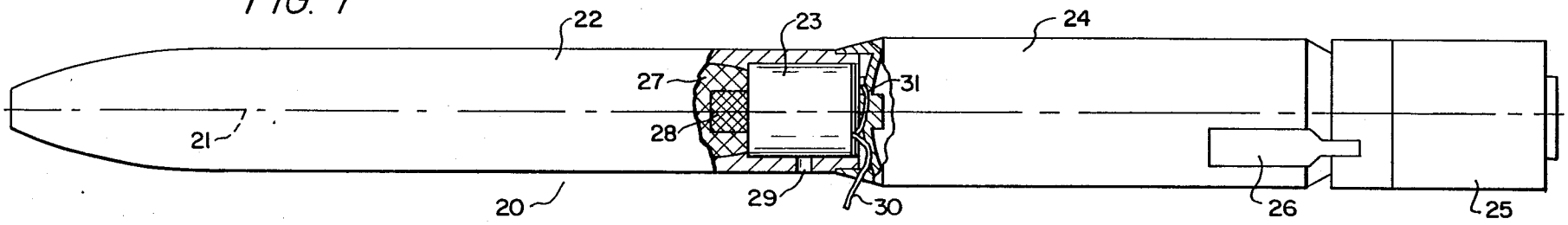
FIG. 1 is the generalized showing, partly in section, of a missile according to the invention.

As shown in FIG. 1, a munition according to the invention comprises a missile 20 elongated along an axis 21 from a forward penetrator 22 through a fuze 23, mounted in the rear of the penetrator, and an electrically ignitable, rearwardly discharging rocket motor 24, to a capsule 25 containing a deployable parachute and secured to motor 24 by electrically releasable latches 26. Penetrator 22 contains a main explosive 27 into which there projects the explosive booster 28 of fuze 23, which is fired by an explosive train more fully described in connection with FIG. 3.

Fuse 23 includes a containment sensor to mechanically prevent fuze operation during storage or transport of the missile. This may be automatic or mechanical: in the drawing it is shown as a threaded pin 29 manually removable when the missile is prepared for launching.

Figure 2:
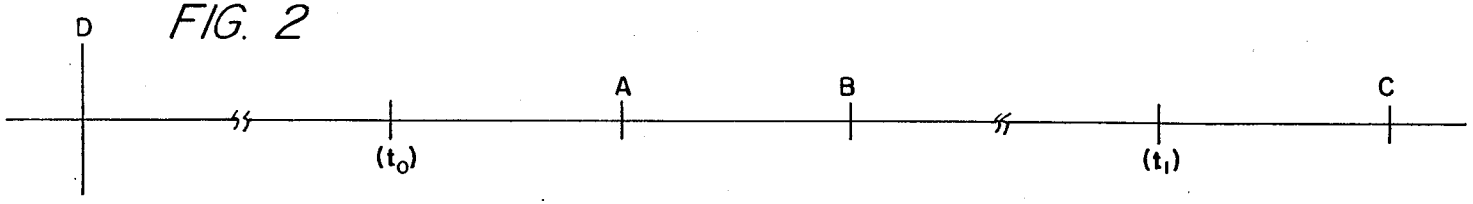
FIG. 2 is a timing diagram.

The desired operation of the missile is suggested in the timing diagram of FIG. 2. If t represents the time of launching, the parachute is to be deployed at a time A, four seconds later, to dissipate the horizontal component of the motion of the missile and so bring it to an attitude in which the axis 21 is substantially vertical. This requires about four seconds, so that at time B the parachute may be released and the rocket motor may be used to greatly increase the descent rate of the missile, whereby to increase its penetrating power. At some subsequent time t the missile contacts the surface, and at a time C thereafter delayed by about 8 milliseconds, the detonator of the fuze is to be energized In order to accomplish these results, fuze 23 is connected to the launching vehicle by a separable umbilical cable 30 and to the rocket motor ignitor and parachute latches by cabling 31.

Figure 3:
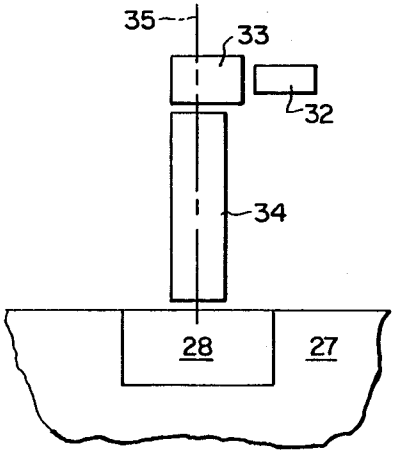
FIG. 3 illustrates schematically an explosive train used in the invention.
Figure 5:
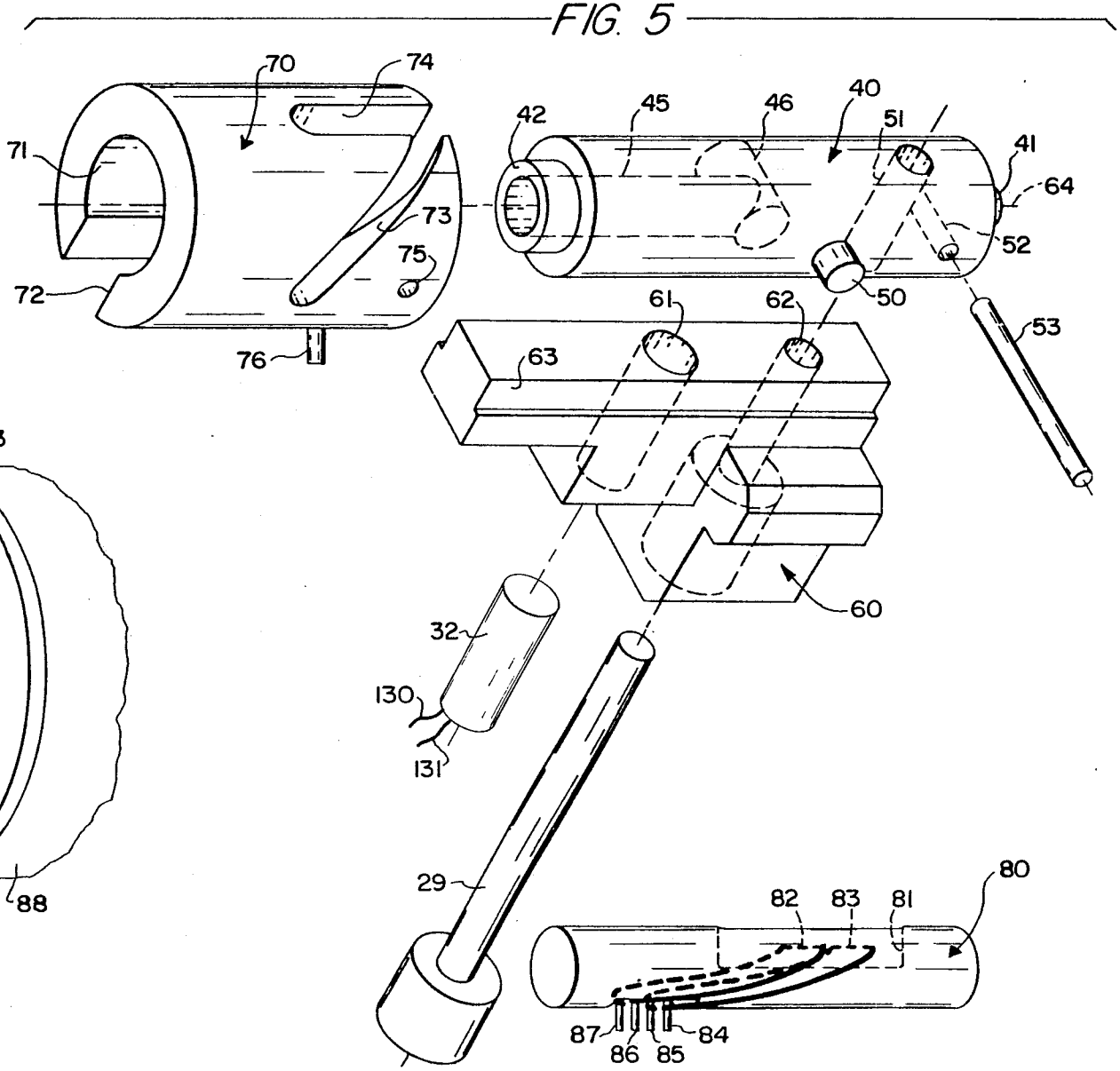
FIG. 5 is an exploded view of the structure of FIG. 4.
Figure 4:
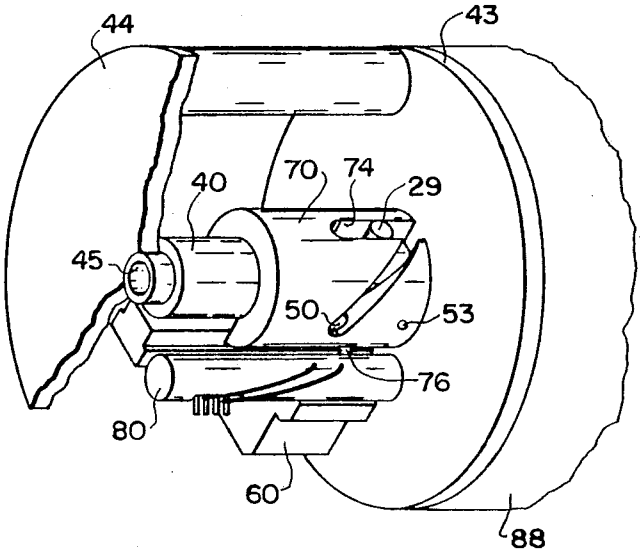
FIG. 4 is a fragmentary view of a fuze used in the invention, with parts broken away for clarity of illustration.

An important part of fuze 23 is a safe-arm mechanism of which pin 29 is a part. Referring to FIG. 3, main explosive 27 is to be fired by booster 28, upon electrical energization of an electrical detonator 32, through an explosive train including explosive leads 33 and 34. These leads are mounted in a tubular metal rotor rotatable about an axis 35 toward which the detonator 32 discharges radially. In an "armed" position of the rotor, lead 33 is aligned with detonator 32, so that the firing is propagated radially into the tube and then axially to booster 28. In a "safe" position of the rotor, lead 33 is rotated out of alignment with the detonator by approximately 90 degrees, so that inadvertent energization and firing of detonator 32 is prevented from reaching the rest of the explosive train. FIGS. 4 and 5 show mechanism to accomplish this.

A tubular rotor 40 is pivotally mounted at its ends 41 and 42 in a pair of plates 43 and 44. An axial bore 45 extends inwardly from end 42 to receive explosive lead 34, and communicates with a radial bore 46 to receive explosive lead 33. A caming pin 50 extends radially outward from rotor 40, which is also provided with a diametrical cross bore 51 to receive containment sensor pin 29, and with a second diametrical cross bore 52 to receive a shear pin 53.

A detonator block 60 is secured to plate 43 and includes a bore 61 to receive detonator 32, a bore 62 to receive pin 29, and a guide track 63 extending parallel to axis 64 of rotor 40. An inertia weight 70 has a bore 71 to rotatably receive rotor 40, and is provided with a longitudinal slot 72 to engage track 63 so that weight 70 may move axially along rotor 40 and track 63, but may not rotate about the rotor axis. A helical slot 73 is provided in weight 70 to receive caming pin 50 of rotor 40, and is in communication at its end with a slot 74 parallel to axis 64. A cross bore 75 receives shear pin 53, and a cutter pin 76 extends radially outward from weight 70.

Figure 6:
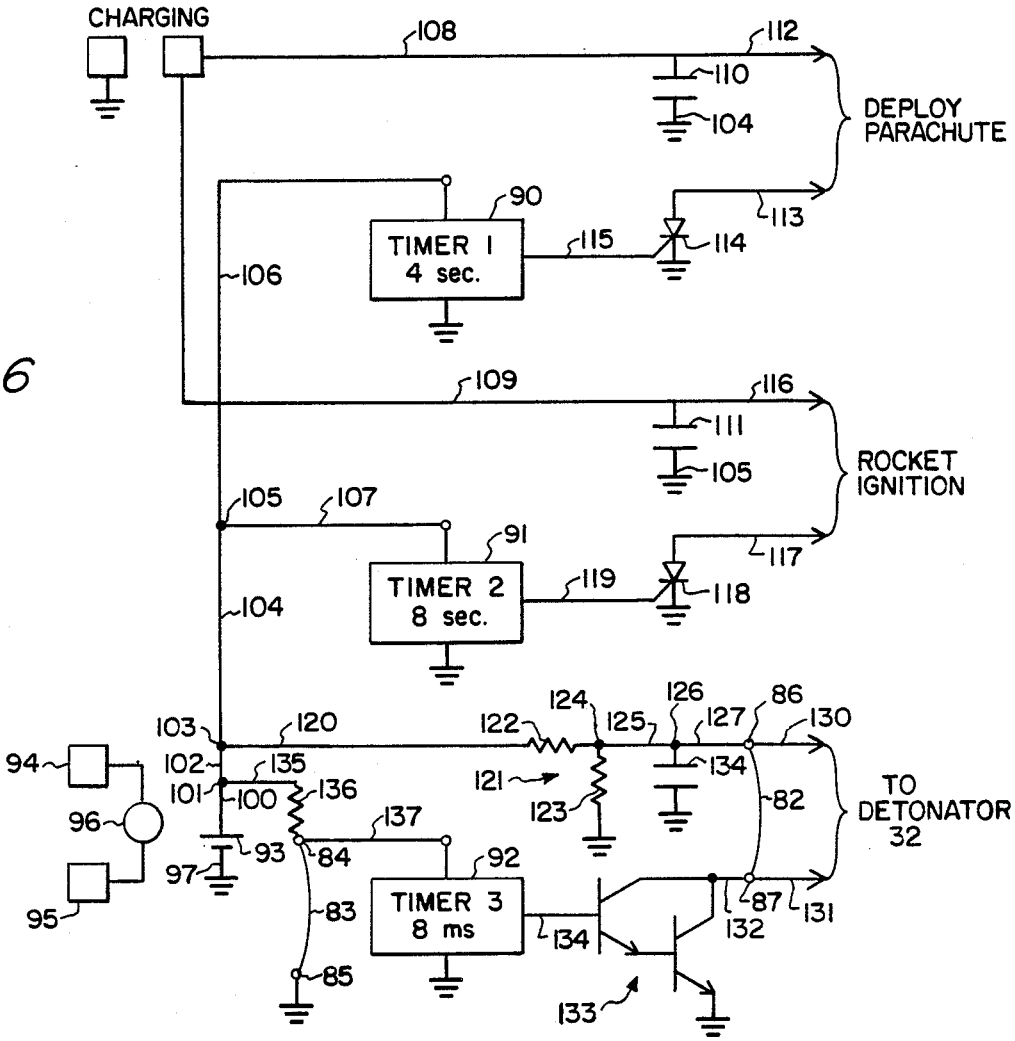
FIG. 6 is a wiring diagram of the apparatus.
Figure 14:
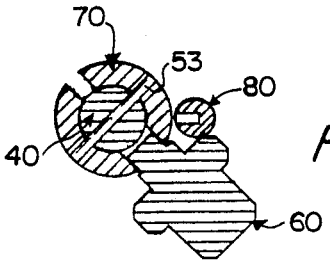
FIGS. 12, 13, and 14 are sections along the lines 12—12, 13—13, and 14—14 respectively of FIG. 11.
Figure 10:
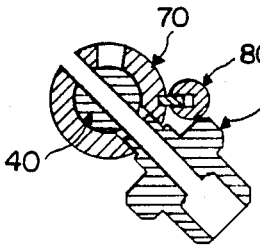
FIGS. 8, 9, and 10 are sections along the lines 8—8, 9—9, and 10—10 respectively of FIG. 7.

An insulating stand-off 80 is mounted on plate 43 to extend parallel to axis 64, and includes a longitudinal groove 81 in which pin 76 of weight 70 travels. A pair of shorting wires 82 and 83 extend across groove 81, in the path of pin 76, and the ends of these wires are connected to terminals 84, 85 and 86, 87 respectively. The potted electronics 88 of the fuze are mounted on the face of plate 43 remote from the mechanism just described, and will now be explained in connection with FIG. 6.

The electrical circuitry of the fuze comprises a first timer 90 with a four-second delay, a second timer 91 with an eight-second delay, and a third timer 92 with an eight-millisecond delay. Electrical energization of the timers is provided by a battery 93, preferably of the reserve cell type which may be placed in operation by an electrical signal to the terminals 94 and 95 of an actuator 96, as is well known in the art.

One terminal of battery 93 is grounded at 97. The other terminal is connected through conductor 100, junction point 101, conductor 102, junction point 103, conductor 104, junction point 105, and conductor 106 to timer 90. Junction point 105 is connected by conductor 107 to timer 91.

Parachute deployment and rocket motor ignition are powered by the discharges of a pair of capacitors 110 and 111 which are charged with respect to ground through conductors 108 and 109 from the vehicle dispensing the munition beginning at a time D FIG. 2, preceding the launch of the missile by a suitable capacitor charging interval such as 15 seconds.

Timer 90 completes the circuit from capacitor 110 to ground through conductor 112, the parachute release latches, conductor 113, and a solid state switch 114 controlled by timer 90 through conductor 115.

Timer 91 completes the circuit from capacitor 111 to ground to conductor 116, the rocket ignition, conductor 117, and a solid state switch 118 controlled by timer 91 through conductor 119.

Junction point 103 is connected through conductor 120 to a voltage divider 121 made up of resistors 122 and 123 having a common terminal 124. From terminal 124 the circuit is completed through conductor 125, junction point 126, conductor 127, terminal 86, and conductor 130 to detonator 32, the circuit being completed through conductor 131, terminal 87, conductor 132, and a Darlington transistor 133 to ground. Shorting wire 82 extends between terminals 86 and 87. Transistor 133 is controlled by timer 92 through conductor 134. The input to timer 92 from battery 93 is taken from junction point 101 through conductor 135, resistor 136, terminal 84, and conductor 137: terminal 85 is grounded. Shorting wire 83 extends between terminals 84 and 85.

OPERATION

To use the invention a missile is assembled as shown in FIG. 1, with fuze 23 inserted into penetrator 22 ahead of rocket motor 24 so that booster 28 energizes explosive 27, and with a parachute attached thereto and packed in canister 25 which is secured to motor 24 by latches 26. In fuze 23, pin 29 and shear pin 53 both pass through rotor 40 and weight 70 to prevent any relative motion therebetween: rotor 40 is so positioned that explosive lead 33 is rotated out of line with detonator 32, and so that explosive lead 34 energizes booster 28. Shorting wires 82 and 83 are in place, and connections are made to the fuze at 31 from the parachute latches and the motor ignition.

In this condition the missile can be stored and transported in safety. Inadvertent energization of detonator 32, as by lightening flash for example, cannot reach explosive lead 33, and pin 29 is of such size as to prevent movement of weight 70 under even the roughest handling during storage and transport.

When the missile is installed in the aircraft, connections are made at 30 for charging capacitors 110 and 111, and for energizing battery actuator 96. Finally, pin 29 is removed, so that rotor 40 and weight 70 are held in place only by shear pin 53.

When the vehicle carrying the munition reaches a suitable discharge location, capacitors 110 and 111 are charged and the missile is then released from the vehicle: at the time of release battery 93 is actuated, so that timers 90 and 91 are started: the input to timer 92 is grounded by shorting wire 83, and shorting wire 82 is provided to prevent premature energization of detonator 32.

The missile is separated from the vehicle, its motion having a large forward component and a small downward component, and the flight of the missile continues generally parallel to its axis as the missile falls.

After four seconds, the munition has separated sufficiently from the vehicle: timer 90 energizes switch 114 to actuate latches 26, canister 25 separates, and the parachute deploys: the force of gravity continues to accelerate the missile downward, but the parachute drag reduces the forward missile component and the mass distribution in the missile is such as to cause the missile to nose downward. After eight more seconds, the missile axis is substantially vertical, and the missile has fallen behind the vehicle and is approaching the target surface. Timer 91 now energizes switch 118 to ignite the rocket motor, which discharges rearwardly, releasing the parachute and giving the missile a large downward acceleration to increase its penetration.

Figure 13:
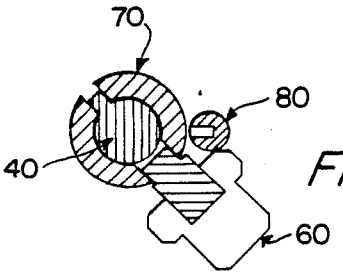
Figure 9:
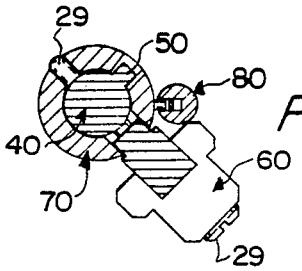
Figure 12:
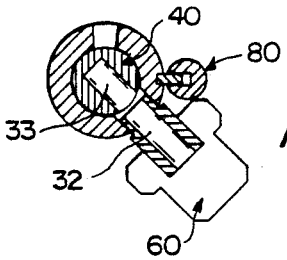
Figure 8:
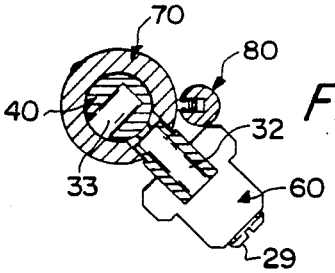
Figure 11:
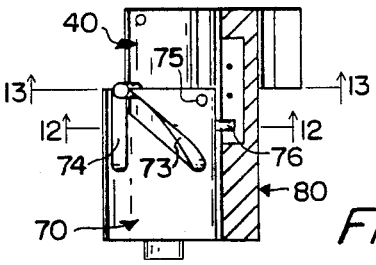
FIG. 11 is a view like FIG. 7 showing the fuze in its fired condition.
Figure 7:
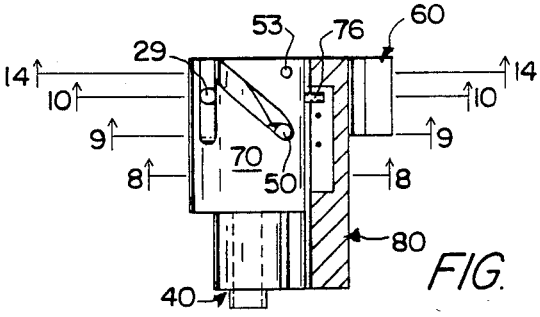
FIG. 7 is a view of a portion of the fuze in its initial condition.

When the missile contacts the target surface, the acceleration of weight 70 is sufficient, 3,000 g's for example, to shear pin 53, allowing the weight to move forward along track 63. Caming pin 50 acts in spiral groove 73 to cause rotation of rotor 40 from the initial position of FIGS. 7, 8, 9, 14 and 10 to that in which explosive lead 33 is aligned with detonator 32 shown in FIGS. 11, 12, and 13. If any rebound of weight 70 occurs, pin 50 simply moves along groove 74, without causing any rotation of rotor 40.

Movement of weight 70 also causes pin 76 to first break shorting wire 83 and then break shorting wire 82, the former energizing timer 92 and the latter enabling detonator 32. After eight milliseconds, the missile has penetrated the surface, and timer 92 energizes transistor 133 to fire detonator 32. The detonator discharge is conducted by leads 33 and 34 to booster 28, which discharges to set off the main explosive 27 of the missile.

From the above it will be evident that the invention comprises a missile having a fuze which maintains the missile in a safe condition until it actually penetrates a target surface, and which delays discharge of the missile until adequate penetration of the target surface has been accomplished, the fuze including a train of explosive leads and mechanism for physically disorienting the train until impact has occurred, and circuitry for preventing discharge of the explosive for an interval after impact.

Numerous characteristics and advantages of the invention have been set forth in the foregoing description, together with details of the structure and function of the invention, and the novel features thereof are pointed out in the appended claims. The disclosure, however is illustrative only, and changes may be made in detail especially in matters of shape, size, and arrangement of parts, within the principle of the invention, to the full extent indicated by the broad general meaning of the terms in which the appended claims are expressed.

We claim:

1. In a fuze, in combination:

a cylindrical rotor having an axis, ends, an axial bore at one end of said axis, said axial bore having an open end, a transverse bore communicating with said axial bore, said bores containing explosive leads, and a radially extending caming pin;

means supporting the ends of said rotor for rotation about said axis;

an inertia weight bored to receive said rotor and having a helical groove to receive said caming pin, so that displacement of said weight along said rotor between first and second positions causes rotation of said rotor between first and second rotated positions thereof;

and a detonator block engaging said weight to enable axial movement and to prevent rotation of said weight about said axis, said block including a radial detonator bore which is aligned with said transverse bore of said rotor in said second rotated position thereof.

2. Apparatus according to claim 1 in which said helical groove communicates with a slot in said weight extending parallel to said axis, to enable rebound of said weight without reverse rotation of said rotor.

3. Apparatus according to claim 1 comprising an explosive booster charge mounted adjacent the open end of said axial bore;

and an electric detonator, mounted in said detonator block so that in said second rotated position of said rotor a discharge of said detonator is conducted through said leads to fire said booster charge, while in said first rotated position of said rotor any discharge of said detonator is isolated from said explosive leads.

4. Apparatus according to claim 3, further including a standoff extending parallel to said axis and carrying at least one shorting wire, which normally short circuits said detonator, and a cutting pint extending from said weight toward said standoff is cut said wire as said weight moves from said first axial position to said second axial position, to thereby enable energization of said detonator.

5. Apparatus of claim 4 further comprising an electronic timing means attached said fuze.

6. Apparatus of claim 5 wherein said electronic timing means comprises first delay means connected to said shorting wire and to said electric detonator wherein cutting of said shorting wire upon impact of said fuze results in a delayed energizing signal to said electric detonator such that discharge of said detonator occurs at a fixed period of time after impact of said fuze, such that firing of said booster charge occurs after penetration by a munition to which said booster charge is attached to.

7. Apparatus of claim 6 wherein said electronic timing means further comprises:

second delay means attached to said fuze, wherein said second delay means receives a launch signal upon launch of the munition to which said fuze is attached, and upon a first time delay after receipt of the launch signal, an open parachute signal from said second delay means causes a parachute attached to the munition to open, thereby causing the munition to drop vertically; and third delay means attached to said fuze and connected to said second delay means, wherein said third delay means receives an open parachute signal from said second delay means when the parachute is opened, and upon a second time delay after receipt of the open parachute signal, a release parachute signal from said third delay means causes the parachute to be detached from the munition.

8. In a fuze, in combination:

a cylindrical rotor having an axis, ends, an axial bore at one end of said axis, a transverse bore communicating with said axial bore, and a radially extending caming pin;

means supporting the ends of said rotor for rotation about said axis;

an inertia weight bored to receive said rotor and having a helical groove to receive said caming pin, so that displacement of said weight along said rotor between first and second positions causes rotation of said rotor between first and second rotated positions thereof;

and a detonator block engaging said weight to enable axial movement and to prevent rotation of said weight about said axis, said block including a radial detonator mounting which is aligned with said transverse bore of said rotor in said second rotated position thereof;

and a shear pin normally preventing relative movement between said weight and said rotor, the mass of said weight and the size and strength of said shear pin being such that said weight shears said pin at a set impact.

9. In a fuze, in combination:

a cylindrical rotor having an axis, ends, an axial bore at one end of said axis, a transverse bore communicating with said axial bore, said bores containing explosive leads, and a radially extending caming pin;

means supporting the ends of said rotor for rotation about said axis;

an inertia weight bored to receive said rotor and having a helical groove to receive said caming pin, so that displacement of said weight along said rotor between first and second positions causes rotation of said rotor between first and second rotated positions thereof;

and a detonator block engaging said weight to enable axial movement and to prevent rotation of said weight about said axis, said block including a radial detonator mounting which is aligned with said transverse bore of said rotor in said second rotated position thereof;

a standoff extending parallel to said axis and carrying a shorting wire;

and a cutting pin extending from said weight toward said standoff to cut said wire as said weight moves from said first axial position to said second axial position.

10. In a fuze, in combination:

a cylindrical rotor having an axis, ends, an axial bore at one end of said axis, a transverse bore communicating with said axial bore, and a radially extending caming pin;

means supporting the ends of said rotor for rotation about said axis;

an inertia weight bored to receive said rotor and having a helical groove to receive said caming pin, so that displacement of said weight along said rotor between first and second positions causes rotation of said rotor between first and second rotated positions thereof;

and a detonator block engaging said weight to enable axial movement and to prevent rotation of said weight about said axis, said block including a radial detonator mounting which is aligned with said transverse bore of said rotor in said second rotated position thereof;

a standoff extending parallel to said axis and carrying a plurality of spaced shorting wires;

and a cutting pin extending from said weight toward said standoff to cut said wires in sequence as said weight moves from said first axial position to said second axial position.

* * * * *